United States Patent [19]

Shafer

[11] 4,260,192

[45] Apr. 7, 1981

[54] RECOVERY OF MAGNESIA FROM OIL SHALE

[75] Inventor: John L. Shafer, Mendham Township, Morris County, N.J.

[73] Assignee: Occidental Research Corporation, Irvine, Calif.

[21] Appl. No.: 13,437

[22] Filed: Feb. 21, 1979

[51] Int. Cl.[3] ..... E21B 43/28; E21C 41/10

[52] U.S. Cl. ..... 299/2; 75/101 R; 208/11 R; 299/5

[58] Field of Search ..... 299/2, 4, 5; 75/101 R; 23/304; 423/165, 166; 208/11 R

[56] References Cited

U.S. PATENT DOCUMENTS

| | | | |
|---|---|---|---|
| 3,455,796 | 7/1969 | Crumb | 423/165 X |
| 3,586,377 | 6/1971 | Ellington | 299/4 |
| 3,915,234 | 10/1975 | Pelofsky | 299/5 X |
| 4,058,587 | 11/1977 | Nelson | 75/101 R X |

*Primary Examiner*—Ernest R. Purser

*Attorney, Agent, or Firm*—Christie, Parker & Hale

[57] ABSTRACT

Magnesium values are leached from a fragmented mass containing combusted oil shale particles. Magnesium is leached selectively with respect to calcium compounds and silicates with aqueous solutions of a mixture of purgeable, acid-forming gases such as carbon dioxide with a minor proportion of sulfur dioxide. A two-stage leaching process can employ leachant with dissolved carbon dioxide and sulfur dioxide in a first stage and with a carbon dioxide containing solution in the substantial absence of sulfur dioxide in the second stage. An enriched solution containing magnesium values is withdrawn from the fragmented mass and magnesia is recovered from such enriched solution. In one embodiment a fragmented permeable mass of formation particles containing oil shale and carbonates of calcium and magnesium is formed in an in situ oil shale retort. A combustion zone is advanced through the fragmented mass, whereby kerogen in oil shale in the fragmented mass is decomposed in a retorting zone on the advancing side of the combustion zone to produce gaseous and liquid products including shale oil, and particles containing retorted oil shale are combusted for converting magnesium values to more leachable form such as magnesium oxide. Such a process is also used for leaching combusted oil shale from above ground retorting and combustion.

45 Claims, 3 Drawing Figures

RECOVERY OF MAGNESIA FROM OIL SHALE

BACKGROUND

This application is related to U.S. Patent Application No. 871,367 filed Jan. 23, 1978 by Robert A. Hard, now U.S. Pat. No. 4,171,146, and assigned to Occidental Research Corporation, assignee of this application. The subject matter of that application is hereby incorporated by this reference.

The selective leaching of magnesium values from spent oil shale is known and described in the aforementioned related patent application. The aforementioned application mentions, but does not claim some aspects of this invention.

The presence of large deposits of oil shale in the Rocky Mountain region of the United States has given rise to extensive efforts to develop methods of recovering shale oil from kerogen in the oil shale deposits. It should be noted that the term "oil shale" as used in the industry is in fact a misnomer; it is neither shale nor does it contain oil. It is a sedimentary formation comprising marlstone deposit having layers containing an organic polymer called "kerogen", which upon heating decomposes to produce hydrocarbon liquid and gaseous products. It is the formation containing kerogen that is called "oil shale" herein, and the liquid hydrocarbon product is called "shale oil".

A number of methods have been proposed for processing oil shale which involve either first mining the kerogen bearing shale and processing the shale above ground, or processing the oil shale in situ. The latter approach is preferable from the standpoint of environmental impact since the spent shale remains in place, reducing the chance of surface contamination and the requirement for disposal of solid wastes.

Although the process disclosed herein for selectively leaching magnesium values from combusted oil shale is primarily discussed in relation to leaching in an in situ oil shale retort, the process can be practiced on spent oil shale produced by other methods of retorting. Many of these methods for shale oil production are described in Synthetic Fuels Data Handbook, compiled by Dr. Thomas A. Hendrickson and published by Cameron Engineers, Inc., Denver, Colorado. For example, other processes for retorting oil shale include those known as the Tosco, Paraho Direct, Paraho Indirect, N-T-U, Union Oil, and Bureau of Mines, Rock Springs, processes. Oil shale can also be processed by a combination of such techniques whereby a portion of the oil shale is excavated to create void space underground and retorted above ground, and another portion is explosively expanded toward such void spaces to form in situ retorts for underground retorting.

The recovery of liquid and gaseous products by retorting in an in situ retort has been described in several patents, one of which is U.S. Pat. No. 3,661,423, to Donald E. Garrett, and incorporated herein by this reference. This patent describes in situ recovery of liquid and gaseous hydrocarbon materials from a subterranean formation containing oil shale by mining out a portion of the subterranean formation and then fragmenting a portion of the remaining formation to form a stationary, fragmented permeable mass of formation particles containing oil shale, referred to herein as an in situ oil shale retort. Hot retorting gases are passed through the in situ oil shale retort to convert kerogen contained in the oil shale to liquid and gaseous products.

One method of supplying hot retorting gases used for converting kerogen contained in the oil shale, as described in U.S. Pat. No. 3,661,423, includes establishment of a combustion zone in the retort and introduction of an oxygen containing retort inlet mixture into the retort as a gaseous combustion zone feed to advance the combustion zone through the retort. In the combustion zone oxygen in the combustion zone feed is depleted by reaction with hot carbonaceous materials to produce heat and combustion gas. By the continued introduction of the gaseous combustion zone feed into the combustion zone, the combustion zone is advanced through the retort. The combustion zone is maintained at a temperature lower than the fusion temperature of oil shale, which is about 2100° F., to avoid plugging of the retort, and above about 1100° F. for efficient recovery of hydrocarbon products from the oil shale.

The effluent gas from the combustion zone comprises combustion gas, carbon dioxide from mineral carbonate decomposition, and any gaseous portion of the combustion zone feed that does not take part in the combustion process. This effluent gas is essentially free of free oxygen and contains constituents such as oxides of carbon, water vapor, nitrogen, and sulfurous compounds. It passes through the fragmented mass in the retort on the advancing side of the combustion zone to heat oil shale in a retorting zone to a temperature sufficient to produce kerogen decomposition, called retorting, in the oil shale to gaseous and liquid products and to a residue of solid carbonaceous material.

The liquid products and gaseous products are cooled by cooler particles in the fragmented mass in the retort on the advancing side of the retorting zone. The liquid hydrocarbon products, including shale oil, together with water produced in or added to the retort, are collected at the bottom of the retort and withdrawn to the surface through an access tunnel, drift or shaft. An effluent gas, referred to herein as off gas, containing combustion gas generated in the combustion zone, gaseous products including methane produced in the retorting zone, carbon dioxide from carbonate decomposition, and any gaseous portion of the combustion zone feed that does not take part in the combustion process is also withdrawn from the bottom of the retort.

Inorganic carbonates can be present in oil shale, notably carbonates of magnesium and calcium which decompose endothermically when heated to their decomposition temperatures. U.S. Pat. No. 4,036,299 to Cha, et al., assigned to the assignee of the present application and incorporated herein by this reference, describes a method of recovering shale oil from oil shale in an in situ oil shale retort in which a combustion zone is advanced through a fragmented permeable mass of formation particles containing oil shale and carbonates of magnesium and calcium. The patent discloses that the combustion zone is maintained at a temperature of from about 1100° F. to about 1400° F. (593°–760° C.), preferably from about 1200° F. to about 130° F. (649°–704° C.), to obtain shale oil while avoiding excessive dilution of gaseous retorting products with carbon dioxide from decomposition of inorganic carbonates, notably calcium carbonate, in the oil shale.

Above-mentioned U.S. Pat. No. 3,661,423 to Garrett discloses briefly that mineral values can be leached from retorted oil shale in an in situ oil shale retort with water, acidic, or alkaline leaching agents. However, there is no description of the selective recovery of magnesium values from combusted oil shale in an in situ oil shale retort.

A number of patents have described the recovery of aluminum values from dawsonitic oil shale retorted above ground or by advancement of a combustion zone through an in situ oil shale retort, by leaching with aqueous leaching agents. Exemplary of these are U.S. Pat. Nos. 3,502,372 to Prats, 3,516,787 to Van Nordstrand, 3,572,838 to Templeton, 3,510,255 to Hall et al., and 3,642,433 to Dyni. The leaching agent typically is water or an alkaline aqueous solution, although the use of dilute acids has also been mentioned. The Van Nordstrand patent states that oil shale can contain from about 10 to 40 weight percent dolomite, and that dolomite in oil shale is decomposed upon retorting to form carbon dioxide, calcite, and magnesium oxide, the magnesium oxide tying up part of the silica in the oil shale to permit higher recovery of the aluminum values by leaching. Recovery of magnesium values is not disclosed in these patents.

The recovery of magnesium values from ground, calcined dolomite, a mineral form of calcium magnesium carbonate, is known. The selective leaching of magnesium values from dolomite calcined at 750°-850° C. with carbonated water has been described, for example, in U.S. Department of the Interior, Bureau of Mines Technical Paper 684, "The Bicarbonate Process for the Production of Magnesium Oxide," by H. A. Doerner et al (1946), the disclosure of which is incorporated herein by this reference. This paper describes the leaching of magnesium values from slurries of finely ground, calcined dolomite in well agitated mixing tanks.

The thermal decomposition of carbonates of magnesium and calcium in oil shale is described in E. J. Jukkola et al., "Thermal Decomposition Rates of Carbonates in Oil Shale," Industrial and Engineering Chemistry, 45 (1953), 2711-2714, which is incorporated herein by this reference. Data obtained by heating oil shale over a range of temperatures under various partial pressures of carbon dioxide are reported. Leaching of magnesium values from retorted oil shale is not described.

U.S. Pat. No. 3,455,796 to Crumb relates to a method for treating residual material from oil shale retorting for recovery of its magnesium content to form magnesium chloride. Crushed oil shale residue is mixed with water and calcium hydroxide if needed to establish a pH of about 10 or higher. The resulting slurry comprises mineral hydrates including magnesium hydroxide, calcium hydroxide and finely divided unreacted particles. The separated slurry is introduced into a primary carbonation stage with a suitable source of carbon dioxide. The carbonation rate is slow enough to assure that calcium carbonate is formed with minimum formation of magnesium carbonate. The slurry is treated in a secondary carbonation stage with additional carbon dioxide and liquid containing magnesium chloride solution to increase calcium carbonate formation. Hydrochloric acid is introduced to neutralize the discharge from the second carbonation to a final pH of about 7.8. Acid is introduced at a slow rate so that magnesium hydrate dissolves without dissolving calcium carbonate to form a solution containing dissolved magnesium chloride.

SUMMARY OF THE INVENTION

The present invention provides a method for recovering shale oil and magnesium values from combusted particles of oil shale containing magnesium values. Such particles are retorted for decomposing kerogen in oil shale in the particles to produce gaseous and liquid products including shale oil and carbonaceous residue, and such retorted particles are heated, for example by combusting carbonaceous residue, at temperatures sufficient for converting magnesium contained therein values to more leachable form, such as magnesium oxide. Magnesium values are selectively leached from the retorted, combusted particles with an acidic, aqueous leaching agent, notably an aqueous solution of purgeable, acid-forming gases, including carbon dioxide and sulfur dioxide. The basic leaching process can be performed in a two-step method.

For the first step, a minor proportion of sulfur dioxide is included with carbon dioxide in the aqueous leaching agent for improving recovery of magnesium values from the combusted particles.

The introduction of sulfur dioxide in the aqueous leaching agent is discontinued at the end of the first step and the second step of the leaching process is performed in the substantial absence of sulfur dioxide.

The sulfur dioxide can be added intermittently to the aqueous leaching agent. The leaching can be carried out in cycles or by any combination or repetition of the two steps of the leaching process.

In an embodiment of the invention, a fragmented permeable mass of formation particles containing oil shale and magnesium values is formed in an in situ oil shale retort in a subterranean formation. A combustion zone is advanced through the fragmented mass for decomposing kerogen in oil shale in a retorting zone on the advancing side of the combustion zone to produce gaseous and liquid products including shale oil and for converting at least a portion of the magnesium values in the fragmented mass to more leachable form.

In another embodiment oil shale is crushed and the particles are retorted by an above ground process. Particles of retorted oil shale are passed through a combustion zone for burning residual carbonaceous material to provide heat for retorting, thereby producing particles of combusted oil shale in which at least a portion of the magnesium values are in more leachable form than in unretorted oil shale.

Temperatures in the combustion zone are in a range that provides good recoverability of magnesium values in subsequent leaching. Temperatures in the combustion zone are at least sufficient for converting magnesium values to a form that is more leachable with solutions of purgeable, acid-forming gas than the form of magnesium values in the raw oil shale.

Leaching of magnesium values from retorted, combusted oil shale in an in situ oil shale retort inherently involves relatively low liquid to solid weight ratios, on the order of about 1 to 1 or 1 to 2. The particles in the retort are relatively large, the greater weight proportion of particles having diameters above about 2 inches. However, the particles are permeable due to decomposition of kerogen and inorganic carbonates in the particles during retorting and combustion.

Efficient leaching of magnesium values from the particles depends upon penetration of leaching agent into the interior of the particles. It has been noted that when retorted, combusted oil shale is leached with an aqueous solution of carbon dioxide, particularly at the low liquid to solid ratios inherent in leaching in an in situ oil shale retort, a barrier can form on or near the surfaces of the particles during leaching. This barrier can interfere with further leaching by decreasing the permeability of the particles, and it may arise by deposition or growth of insoluble mineral crystals, notably calcium carbonate or calcium-magnesium silicate crystals, on or near the surfaces during leaching. The aforementioned related patent application teaches combustion temperature control to prevent formation of undesirable quantities of calcium oxide in the formation particles. Nevertheless, some quantities of calcium oxides may form despite combustion temperature and rate controls, due to lengthy periods at high temperature encountered in field retorting conditions. Such conditions tend to favor endothermic chemical reactions over relatively lengthy periods of time. The present invention provides a method for maintaining permeability of the combusted particles to acidic aqueous leaching agents.

After retorting and combustion of oil shale, magnesium values are selectively leached from combusted particles with an acidic, aqueous leaching agent, notably an aqueous solution of carbon dioxide containing a minor proportion of sulfur dioxide, for forming an enriched solution containing magnesium values. Such enriched solution is withdrawn from a mass of such particles and magnesium values are recovered therefrom.

DRAWINGS

CONTENTS OF DESCRIPTION

| | |
|---|---|
| Leaching Phase | |
| (a) | Carbon dioxide leaching phenomena |
| (b) | Mineralogical phenomena |
| (c) | Leaching with sulfur dioxide |
| (d) | Second stage leaching |
| (e) | Leaching operations |
| Retorting Phase | |
| (a) | Retorting operations |
| (b) | Temperature effects |
| Laboratory Results | |

INTRODUCTION

The description of the process of this invention can be in two interrelated phases. In the first phase oil shale is fragmented, retorted and conbusted to produce combusted oil shale particles in which magnesium values are in a more leachable form than in raw or unretorted oil shale. The second phase involves leaching a mass of such particles with an acidic aqueous leachant containing dissolved carbon dioxide to selectively leach magnesium values from combusted oil shale. The description sometimes blends the two phases as an aid to understanding. A substantial portion of the description of the retorting phase concerns in situ retorting since the long time at elevated temperature in such a process and the inherent low liquid to solid ratios during leaching in situ can complicate subsequent leaching.

In an above ground retorting process mine-run oil shale is crushed to small particle size and then heated to retorting temperature to recover liquid and gaseous products. The retorted oil shale contains carbonaceous residue. This residue is burned to produce heat for retorting and results in combusted oil shale. The combustion zone can be passed through a mass of retorted oil shale, or the combustion zone can remain in a substantially constant location and a mass of retorted oil shale passed through it. The retorting and combustion zones can be in the same or different vessels depending on the process employed.

Figure 1:
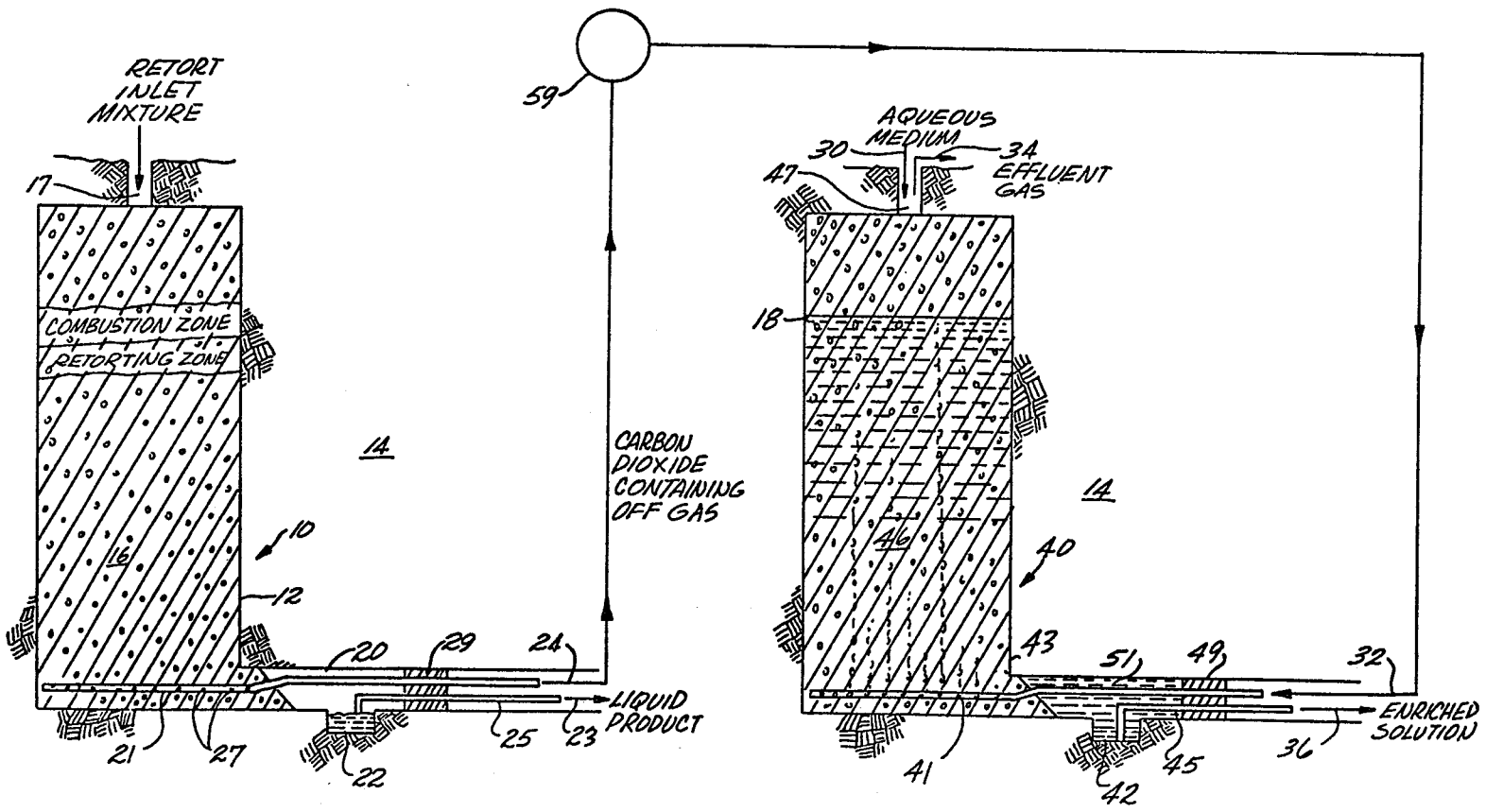
FIG. 1 illustrates in schematic vertical cross section an active in situ oil shale retort undergoing retorting and a spent retort undergoing leaching, off gas from the active retort being introduced to the spent retort for supplying carbon dioxide for leaching.

In an in situ process a fragmented permeable mass of formation particles containing oil shale in an in situ oil shale retort is formed in a subterranean formation containing oil shale. Referring briefly to FIG. 1, a combustion zone is advanced through the fragmented mass 16 in an in situ retort 10 by introducing an inlet mixture through conduit 17 and withdrawing an off gas through a drift 20 by means of perforated pipes 21. Kerogen in oil shale in a retorting zone on the advancing side of the combustion zone is decomposed to produce gaseous and liquid products which are withdrawn through the drift 20, and retorted particles containing residual carbon. Residual carbon supports combustion in the combustion zone.

Particles combusted at maximum temperatures less than about 900° C. contain magnesium values in a form, e.g. magnesium oxide or magnesium hydroxide, that is readily leachable with an aqueous solution of carbon dioxide. Combusted particles can also contain other oxides, notably calcium oxide and mineral slags such as akermanite.

The improvement of this invention can be practiced in two distinct but interrelated stages. In both stages, magnesium values are leached from combusted oil shale particles with carbonated water. In the initial phase, a small proportion of sulfur dioxide gas is dissolved in the carbonated aqueous leaching agent. At least a portion of the fragmented mass of particles is contacted with aqueous medium, and gas-containing sulfur dioxide and carbon dioxide is introduced into the portion of the fragmented particles in contact with the aqueous medium. Conditions of temperature and pressure which favor high concentrations of dissolved carbon dioxide in the aqueous medium are preferred. Magnesium values are leached from combusted particles to form an enriched solution containing dissolved magnesium values, dissolved carbon dioxide, dissolved sulfur dioxide and small amounts of dissolved calcium salts. Such enriched solution is withdrawn from the particles, and magnesium values can be recovered.

In the second stage, the introduction of sulfur dioxide in the aqueous leaching agent is discontinued, and the leaching operation is carried out with a carbonated aqueous medium in the substantial absence of sulfur dioxide to form an enriched solution containing dissolved magnesium values and dissolved carbon dioxide. Withdrawal of such enriched solution and recovery of magnesium values therefrom are carried out in accordance with known techniques. Recovered magnesium values can be processed in accordance with known methods for conversion to magnesium.

Inasmuch as the operation of an oil shale retort has been described in publications and the patent literature, the leaching phase of the method of the present invention will first be discussed in detail.

LEACHING PHASE

(a) Carbon dioxide leaching phenomena

In practice of this invention, magnesium values are selectively leached from the mass of combusted oil shale by contacting particles in the mass with an aqueous solution containing purgeable, acid-forming gases such as dissolved carbon dioxide with a minor proportion of dissolved sulfur dioxide. It is believed that the aqueous carbon dioxide carbonates and dissolves leachable magnesium values. A mechanism for leaching of magnesium oxide, for example, can proceed in accordance with the chemical equations:

$$MgO + xH_2O + CO_2 \rightarrow MgCO_3(H_2O)_x, \text{ and} \quad (1)$$

$$MgCO_3(H_2O)x + CO_2 \rightarrow Mg(HCO_3)_2 + (x-1)H_2O \quad (2)$$

or directly, for example, in accordance with the chemical equation $$MgO + H_2O + 2CO_2 \rightarrow Mg(HCO_3)_2. \quad (3)$$

The $Mg(HCO_3)_2$ is believed to exist in aqueous solution containing dissolved carbon dioxide.

When carbon dioxide is in solution in water, it forms an acidic solution known as carbonic acid. The solution can contain solvated hydrogen ions and solvated bicarbonate ions. It is believed that magnesium bicarbonate can be present in such a solution in equilibrium with bicarbonate ion. When carbon dioxide is removed from such a solution, the concentration of bicarbonate ion drops and magnesium bicarbonate dissociates to form insoluble magnesium carbonate. Regardless of the actual mechanism and regardless of the actual species present in solution, the phrase "containing dissolved carbon dioxide" as it is used herein is intended to include all species, whether ionic or nonionic, which may be formed when gaseous carbon dioxide is dissolved in an aqueous medium. Similarly, as used herein, the phrase "containing dissolved sulfur dioxide" is intended to include all species, whether ionic or nonionic, which may be formed when gaseous sulfur dioxide is dissolved in aqueous medium. The phrase "containing dissolved magnesium bicarbonate" is intended to include any dissolved form of magnesium in an aqueous solution containing dissolved carbon dioxide which precipitates as magnesium carbonate when carbon dioxide is removed from the solution.

When an aqueous solution of carbon dioxide is contacted with retorted, combusted oil shale containing alkaline earth metal oxides such as oxides of magnesium and calcium, the solution becomes enriched with magnesium values, and the pH of the solution increases and can become slightly alkaline because of the buffering action of dissolved magnesium bicarbonate. During leaching, the pH of the leaching agent can thus be slightly over 7, for example, about 7.2, even when dissolved carbon dioxide is present in the leaching agent. Such a slightly alkaline leaching solution is intended to be included within the meaning of the term "acidic, aqueous leaching agent" as the term is used herein because the dissolved carbon dioxide continues to act as an acid in acid-base reaction with the leachable magnesium values in the oil shale.

Conditions that favor increased concentration of dissolved carbon dioxide or species resulting therefrom in the leaching solution also favor leaching of magnesium values and increased concentration of magnesium values in solution. Briefly, such conditions include low temperature and high pressure, as discussed in greater detail below.

Particles containing combusted oil shale in the cooled fragmented mass are contacted with an aqueous solution of carbon dioxide at temperatures above the freezing point of the solution, preferably in the range of between about 10° C. and 60° C. Such temperatures are preferred for obtaining sufficient concentrations of magnesium values and carbon dioxide in solution for economical recovery. At temperatures substantially above 60° C., the solubility of carbon dioxide and of magnesium values is low. Solution temperatures below about 10° C. can be difficult to maintain because the leaching is exothermic and the temperature of the leaching solution tends to rise during leaching.

The effective partial pressure of carbon dioxide in at least a portion of the fragmented mass in contact with aqueous leaching agent is preferably at least about one-half atmosphere, more preferably at least about one atmosphere, to provide sufficient dissolved carbon dioxide in the leaching agent. The solubility of the gas increases with increased partial pressure of the gas. The effective partial pressure is the actual partial pressure of carbon dioxide in a gaseous phase in contact with aqueous leaching agent containing dissolved carbon dioxide in the fragmented mass or the partial pressure of carbon dioxide in a gas phase which would be in equilibrium when in contact with such aqueous leaching agent containing dissolved carbon dioxide. Effective partial pressures of carbon dioxide below about one-half atmosphere can result in a low recovery of magnesium values because of the low concentration of magnesium values in the enriched solution withdrawn from the retort.

Leaching conditions in an in situ oil shale retort or in a static bed of combusted oil shale particles from above ground retorting are inherently characterized by low weight ratios of liquid to solid because the void fraction, i.e., the fraction of the total volume of the fragmented mass attributable to voids and interstices between and among the particles is on the order of about 10 to 40 volume percent. Thus, the volume of liquid that an in situ oil shale retort can hold is limited. Even though particles containing combusted oil shale have a porosity on the order of 20 to 35 percent by volume, at least a portion of which is permeable, and can absorb substantial quantities of water, the weight ratio of liquid to solid in such an in situ retort during leaching is generally less than one to one. Such ratios can be lower than about one half to one, even when the fragmented mass is substantially flooded with leaching agent. Liquid to solid ratios in heap or in situ leaching of combusted oil shale are therefore relatively low compared with, for example, liquid to solid ratios for above-ground leaching of slurries in agitated tanks, in which the liquid to solid weight ratio can be greater than one, e.g. five to one, ten to one, or higher.

(b) Mineralogical phenomena

The subterranean formation containing oil shale contains large quantities of alkaline earth metal carbonates, principally carbonates of calcium and magnesium which during retorting and combustion are at least partly calcined to produce alkaline earth metal oxides. For example, oil shale in the formation can contain approximately 8 to 12 weight percent calcium and 1.5 to 3 weight percent magnesium present as carbonates.

Carbonate of magnesium is widely distributed in both dawsonitic and non-dawsonitic oil shales in the Piceance Creek Basin and can be a significant source of magnesia, given practical techniques for recovery of the magnesium values.

Magnesium carbonate can be present initially in the formation in a variety of mineral forms of varying composition, such as magnesite or brucite; in association with calcium carbonate as dolomite, a calcium-magnesium carbonate; with iron as ferroan, an iron-magnesium carbonate; and with calcium and iron as ankerite, a form of dolomite in which there is about 15 percent iron substituted for magnesium. In stoichiometric dolomite, there is one magnesium atom per calcium atom. Calcium-rich dolomites having ratios of magnesium to calcium of less than one also occur. The aforementioned mineral forms, and others including illite, dawsonite, analcime, aragonite, calcite, quartz, potassium feldspar, sodium feldspar, nahcolite, siderite, pyrite, and fluorite, have been identified by x-ray diffraction analysis. The presence of such mineral forms in oil shale has been reported in W. Rob et al., "Mineral Profile of Oil Shales in Colorado Core Hole No. 1, Piceance Creek Basin, Colorado", *Energy Resources of the Piceance Creek Basin, Colorado,* D. Keith Murray, Ed., Rocky Mountain Association of Geologists, Denver, Colorado, pages 91–100, (1974) and E. Cook, "Thermal Analysis of Oil Shales", *Quarterly of the Colorado School of Mines,* Vol. 65, pages 133–140 (1970), the disclosures of which are incorporated herein by this reference.

Magnesium carbonate in raw oil shale is not readily leachable with carbonated water, in part because kerogen in the oil shale physically prevents contact between the magnesium carbonate and leaching agent, and in part because the magnesium containing shale is initially in a form that is relatively difficult to leach. After oil shale is retorted, carbonaceous residue in the retorted oil shale supports combustion. The resulting combusted oil shale is somewhat permeable.

Magnesium values that can be leached from combusted oil shale with carbonated water include magnesium oxide and various other compounds including magnesium. Combusted oil shale particles can contain substantial quantities of calcium oxide and magnesium oxide. Smaller quantities of other oxides can also be present.

Treatment of combusted oil shale particles can result in conversion of at least a portion of the magnesium oxide to other leachable forms. Thus, contacting magnesium oxide with water or water vapor or gaseous carbon dioxide can convert magnesium oxide to other forms which are leachable with carbonated water, including magnesium hydroxide, magnesium carbonate, basic magnesium carbonate such as $MgCO_3.Mg(OH)_2.3H_2O$ and $3MgCO_3.Mg(OH)_2.3H_2O$, and hydrates such as magnesium carbonate trihydrate and magnesium carbonate pentahydrate.

Previous laboratory studies of leaching of mineral values from dolomite particles have typically involved calcining times on the order of several hours to at most a week. Yet, under actual field conditions, overall reaction times of an in situ oil shale retort can be on the order of 100 days. The length of the retorting and combustion process promotes formation of mineral compounds which have very low kinetic rate constants. Such compounds will not normally appear under laboratory conditions, because laboratory time scales have been too short to permit appreciable formation of compounds with low kinetic rate constants.

Certain oil shale rock formations used in practicing this process, for example, in an in situ oil shale retort in the Piceance Creek Basin in Colorado, contain silicates. It is found that certain compounds, in particular akermanite, are formed in such an oil shale retort during the lengthy combustion of the formation particulates. Substantial quantities of magnesium values are believed to be tied up in such combustion-formed silicates and will not leach readily. It is found that the addition of sulfur dioxide to the carbon dioxide-containing aqueous leaching agent improves leaching of magnesium values from the combusted particles. It is believed that sulfur dioxide may chemically attack or etch away or dissolve silicates from the combusted particles, thereby exposing magnesium values contained therein, such as magnesium oxide, to the carbon dioxide-containing aqueous leaching agent. Thus, leaching of magnesium values from combusted particles is facilitated by addition of sulfur dioxide to the carbon dioxide-containing aqueous leaching agent.

Also the size and distribution of sizes of particles in the fragmented mass can affect the rate of leaching and the recovery of magnesium values. The fragmented mass can have a wide distribution of particle sizes. The fragmented mass of formation particles in an in situ retort can have the greater part of its weight, i.e., greater than 50 percent of its weight, in particles having average effective diameters above about 2 inches. For example, an in situ oil shale retort in the Piceance Creek Basin of Colorado prepared by explosive expansion of formation toward a void is thought to contain a fragmented permeable mass consisting of about 58% by weight particles having a weight average effective diameter of 2 inches, about 23% by weight particles having a weight average diameter of 8 inches, and about 19% by weight particles having a weight average diameter of 30 inches.

When particles of combusted oil shale are contacted with carbonated water at low liquid to solid ratios, e.g., about two, some magnesium values are leached, but the rate of leaching can prematurely fall off, sometimes almost to zero. It appears that a mineral crystal barrier can form during leaching on or within the particles and interfere with further leaching. Observation of particles with a scanning electron microscope has confirmed that crystal growth or scaling can occur on or near the surfaces of the particles during leaching at low liquid to solid ratios. At least a portion of such crystals appear upon visual inspection to be gypsum. Without intending to be bound by a particular theory, it is hypothesized that calcium minerals initially dissolve in the leaching agent and reach saturation, and calcium minerals of low solubility in the acidic aqueous leaching agent crystallize out of solution upon the particles being leached to form a barrier that retards or halts diffusion of leaching agent into and out of the particles.

The formation of such a barrier is especially disadvantageous when particles in an in situ retort are being leached because the weight average effective diameter of the particles in relatively large, for example, about 2 inches, and a substantial proportion of the particles can have effective diameters greater than 18 inches. Leaching of combusted oil shale in an in situ retort is effective because, among other reasons, the particles are permeable and therefore have a very high effective surface area available for leaching. A mineral crystal barrier near the outer surfaces of the particles can retard or prevent leaching agent from entering the interior of the particles. As a result, leaching can be slowed to an impractical rate or even be halted. Such an effect has been observed in laboratory leaching tests using ⅛ inch to ¼ inch particles of combusted oil shale. Larger particle sizes exacerbate the effect.

(c) Leaching with sulfur dioxide

In the first stage of the leaching process the particles containing combusted oil shale retort are contacted with an acidic aqueous leaching agent containing a major proportion of dissolved carbon dioxide and a minor proportion of dissolved sulfur dioxide for selectively leaching magnesium values and forming an enriched solution containing dissolved carbon dioxide and magnesium values. The amount of sulfur dioxide added lowers the pH of the carbon dioxide containing solution about one third to one unit of pH. It is believed that sufficient sulfur dioxide to lower the pH about one third unit can provide sufficient dissolving action to attack silicate minerals containing magnesium. Sulfur dioxide sufficient to lower the pH more than about one unit can lead to insoluble sulfites and the like and can cause solution of excessive calcium. Lowering of pH from about ⅓ to one unit can be obtained when the sulfur dioxide effective partial pressure is in the range of from about one to three percent of the partial pressure of the carbon dioxide.

The theoretical solubility of magnesium values in aqueous solution in equilibrium with combusted oil shale particles depends in part on the chemical composition of the combusted substrate material. Such substrate material can be composed largely of silicates, largely akermanite, after combustion in an in situ retort, and before initiation of a leaching process. It is believed that sulfur dioxide in an aqueous leaching agent containing dissolved carbon dioxide can chemically attack or etch away silicate from the combusted particles thereby effectively changing the composition of the substrate material. It follows that the solubility of magnesium values in equilibrium with the altered substrate material will differ accordingly. It is thought that the equilibrium solubility of magnesium values in a carbon dioxide containing solution increases with such an altered substrate. Thus, a leaching process performed with a combination of sulfur dioxide and carbon dioxide gases permits a greater leaching of magnesium values compared to a carbonated water leaching process carried out in the substantial absence of sulfur dioxide.

It is recognized in the aforementioned related patent application that the presence of appreciable quantities of calcium oxide in the combusted particles can inhibit the selective leaching of magnesium values. It is believed that carbonation of calcium oxide, to reform calcium carbonate, can create a barrier to penetration of the aqueous leaching agent into the interiors of the combusted particles. Reformation of calcium carbonate, which is relatively insoluble in carbonated water, effectively decreases the permeability of the combusted particles to the aqueous leaching agent. Thus, the leaching of magnesium values from the combusted particles is inhibited under conditions which promote the recarbonation of calcium oxides during leaching. Conversely, conditions that inhibit the recarbonation of calcium oxide during leaching will improve the overall leaching of magnesium values. It is believed that sulfur dioxide dissolved in the aqueous leaching agent combines with calcium oxides in the outer surfaces of the combusted particles to form a protective film of calcium sulfite on surfaces of the combusted particles. Such a protective film of calcium sulfite may inhibit formation of calcium carbonate. Thus, introduction of sulfur dioxide, a condition thought to inhibit the carbonation of calcium oxides during leaching, is found to improve the overall leaching of magnesium values from the combusted particles.

The addition of sulfur dioxide to carbon dioxide in the aqueous leaching agent reduces the pH of the leaching agent and helps to leach magnesium values. Nevertheless, an excess of sulfur dioxide can be deleterious to leaching since it reduces the solubility of magnesium oxide. Therefore, to practice this process, it is preferable to include sufficient sulfur dioxide in the aqueous leaching agent that the concentration of sulfur dioxide promotes the formation of magnesium bicarbonate in solution and yet is sufficiently low to avoid the formation of magnesium bisulfate or magnesium sulfite in appreciable quantities in solution. Quantatively, concentrations of sulfur dioxide in solution of from about 1 to 3% of the concentration of dissolved carbon dioxide in the aqueous leaching agent have been found by empirical testing to be sufficient.

Preferably, it is desired to obtain magnesium bicarbonate in solution, not magnesium bisulfate or magnesium sulfite. A mechanism for formation of magnesium bisulfite or magnesium sulfite, for example, can proceed in accordance with the chemical equations:

$$MgO + xH_2O + SO_2 \rightarrow MgSO_3(H_2O)_x, \text{ and} \quad (4)$$

$$MgSO_3(H_2O)_x + SO_2 \rightarrow Mg(HSO_3)_2 + (x-1)H_2O, \text{ and} \quad (5)$$

$$MgSO_3(H_2O) + CO_2 \rightarrow MgSO_3 + H_2CO_3, \quad (6)$$

or directly, for example, in accordance with the chemical equation:

$$MgO + H_2O + 2SO_2 \rightarrow Mg(HSO_3)_2. \quad (7)$$

The $Mg(HSO_3)_2$ is believed to exist in aqueous solution containing dissolved carbon dioxide and dissolved sulfur dioxide.

(d) Second stage leaching

It is found that the addition of dissolved sulfur dioxide gas to the carbon dioxide-containing aqueous leaching agent aids in leaching magnesium values from the combusted particles. Nevertheless, it has been empirically found that a maximum concentration of magnesium values in pregnant solution is reached, after which it is preferable to discontinue the introduction of sulfur dioxide to the carbon dioxide-containing aqueous leaching agent, thereafter continuing the leaching process with a carbon dioxide-containing aqueous leaching agent in the substantial absence of sulfur dioxide. It is found that the sulfur dioxide is essentially self-purging from the combusted particles and aqueous medium since the sulfur dioxide and magnesium sulfite, if any is formed, eventually pass through the fragmented mass of particles and are present in the pregnant solution.

Sulfur dioxide containing solution is not as selective in dissolving magnesium values versus calcium values as is carbon dioxide containing solution in the substantial absence of sulfur dioxide. Thus some calcium values can also be present in the withdrawn solution in the first stage of leaching. Recovery of magnesium values directly from such solution could yield some calcium as well. This can be avoided by using pregnant solution from the first stage of leaching in a second stage of leaching. The sulfur dioxide concentration of the solution decreases as it contacts combusted oil shale and sulfur dioxide is self-purged. Further, once sulfur dioxide leaching has been conducted minor amounts of sulfite and sulfate compounds can be present in second stage leaching solutions. Second stage leaching is considered to be conducted in the substantial absence of sulfur dioxide regardless of such incidental residues in the solution.

Empirically, it is found that the leaching of magnesium values during the first step of the leaching process, in the presence of sulfur dioxide, rises initially but reaches a maximum and thereafter declines. It has been found that such maximum concentration of magnesium values occurs about two days after the commencement of leaching with sulfur dioxide for oil shale with a particle size in the range of about 6 mesh to ¼ inch. When the process is practiced in an in situ oil shale retort containing large particles and with appreciable residence time of solution in the retort, long intervals can occur.

In practice of this process, it is desirable to take samples of leaching solutions to follow the rate of magnesium leaching as a function of time when sulfur dioxide is used in the aqueous leaching agent. A graph of magnesium concentration in the pregnant solution plotted against time reveals a single maximum value of magnesium concentration. The time coordinate of the maximum leaching of magnesium values is the preferred cutoff time for discontinuing the introduction of sulfur dioxide into the aqueous leaching agent. The leaching process can be performed for a sufficient additional time interval after such maximum value is obtained in order to observe the decline in concentration of magnesium values which indicates that the maximum value has been reached. Leaching of magnesium values for such an additional time interval in the presence of sulfur dioxide does not impair the further leaching of magnesium values with a carbon dioxide containing aqueous leaching agent in the substantial absence of sulfur dioxide. It is found that use of such two stage leaching process permits an increased recovery of magnesium values which may approach the theoretical equilibrium solubility of magnesium species in carbonated aqueous medium.

(e) Leaching operations

Leaching of combusted oil shale particles from above ground retorting processes can be conducted in vats or tanks with agitation. Such techniques are well known for leaching and involve relatively high liquid to solid ratios. Vat leaching can be either a batch or continuous process, preferably the latter with continuous countercurrent flow of particles and solution. Heap leaching can also be used where a bed of combusted oil shale particles is formed on a substrate which is impermeable or has very low permeability. Leachant percolates downwardly through such a mass of particles and is withdrawn from the bottom. Heap leaching is a batch type of process. Leaching in an in situ oil shale retort is also a batch type process and is described in somewhat greater detail.

For economy, the conduit means 17 used for introducing an inlet mixture to the in situ retort 10 during the retorting operation can be used for introducing carbon dioxide containing solution to the retort or for withdrawing effluent solution from the retort. Similarly, the pipe or pipes 21 or other means used for withdrawing off gas from the retort during the retorting operation can be used for introducing carbon dioxide containing solution in the retort or for withdrawing effluent solution from the retort.

Trickle leaching or flood leaching can be used for contacting particles in the cooled fragmented mass with the aqueous solution of carbon dioxide. In trickle leaching, as in the above ground heap leaching, particles in the fragmented mass are wetted with leaching agent that flows downwardly through the mass, but the void spaces between particles in the mass are largely occupied by gas. In flood leaching, the void spaces are largely occupied by liquid leaching agent, and the leaching agent can flow upwardly, downwardly, or laterally through the fragmented mass.

With either trickle leaching or flood leaching, aqueous solution can be formed outside of the retort and can then be introduced to the fragmented mass in the retort. Carbon dioxide and/or sulfur dioxide can be dissolved in aqueous medium, such as water or an aqueous recycle stream from leaching operations, at ambient pressure or higher pressures and the resultant aqueous solution can be introduced into the retort at ambient or higher pressures. Because the solubility of a gas in a liquid is higher at lower temperatures, the solution is preferably prepared at leaching temperatures or lower, for example, at temperatures in the range of about 10° to 60° C. or lower, and preferably at pressures at least as high as the highest pressure in the retort during leaching.

The carbon dioxide can be commercial carbon dioxide, e.g. from cylinders or solid carbon dioxide, or carbon dioxide in off gas, burned off gas, tail gas from combustion of fuel, or kiln gas obtained in the calcining of magnesium carbonate to produce magnesia. Mixtures of such gases can be used.

The sulfur dioxide can be from commercial sources of compressed gas, or from combustion of sulfur or hydrogen sulfide. Sufficient amounts of sulfur dioxide can be present in some combustion flue gas streams. Off gas from an in situ oil shale retort can contain hydrogen sulfide gas. Such hydrogen sulfide gas can be treated by known methods, such as passing it through an amine scrubber, containing monoethanolamine or diethanolamine for concentrating the hydrogen sulfide which is then converted to sulfur dioxide. Such amine scrubbing of retort off gas can be advantageous since the amine scrubber also concentrates carbon dioxide and a solution containing carbon dioxide and sulfur dioxide in about the preferred proportions for leaching can readily be formed. Such converted sulfur dioxide and carbon dioxide can be dissolved in aqueous medium for introduction to the combusted particles or it can be introduced to the fragmented mass as gaseous sulfur dioxide.

In an embodiment of the present invention, the cooled fragmented mass in an in situ oil shale retort is substantially flooded with downwardly flowing aqueous medium, and carbon dioxide containing gas as is introduced near the bottom of the fragmented mass. During the first phase of leaching the gas includes sulfur dioxide. An enriched solution containing magnesium values is withdrawn from the fragmented mass at the bottom of the retort. Referring again to FIG. 1, aqueous medium 30 is introduced to a fragmented mass of particles 46 containing combusted oil shale in an in situ oil shale retort 40 through the conduit 47 and substantially floods at least a portion of the fragmented mass, for example, the portion of the fragmented mass below a liquid level indicated at line 48. A sealing bulkhead 49 in the lower drift 51 holds the liquid in the retort.

The introduced aqueous medium 30 flows downwardly through the fragmented mass 46 and contacts particles therein. Carbon dioxide containing off gas 24 is withdrawn from the active retort 10, is compressed in compressor 59, is introduced through line 32 and gas introduction means 41 such as perforated pipes to the fragmented mass 46, and flows upwardly through the mass. Carbon dioxide from the gas dissolves in the aqueous medium and reacts with leachable magnesium values in the fragmented mass. Sulfur dioxide can be included in the gas by addition from storage containers or from gas generated by burning sulfur, for example. Retort off gas can contain sulfurous compounds such as hydrogen sulfide and these can be oxidized for providing at least a portion of the sulfur dioxide. Continued introduction of gas replenishes the concentration of dissolved gases in the aqueous medium for dissolving magnesium values and holding dissolved magnesium values in solution. During the first phase, sulfur dioxide dissolved in the aqueous leachant containing carbon dioxide aids in leaching of magnesium values from the fragmented mass. In a later phase carbon dioxide is included in the substantial absence of sulfur dioxide.

As aqueous medium flows downwardly through the fragmented mass, it becomes enriched with magnesium values, carbon dioxide, sulfur dioxide, and also dissolved water soluble materials such as sodium salts and sulfates. Magnesium values are selectively dissolved with respect to calcium minerals, which to a great extent remain behind as insoluble calcium compounds such as calcium carbonate; substantially insoluble silicates, which are present in the raw shale or are formed during retorting; and other minerals, such as akermanite and aluminum compounds, that are relatively insoluble in carbonated water.

Pressure at the bottom of the retort can be high owing to the hydrostatic head of liquid in the retort. In flood leaching, pressures as high as 10 to 15 atmospheres above ambient or higher can be encountered at the bottom of the retort, depending upon the height of the column of liquid in the retort. The effective partial pressure of carbon dioxide can be as high as the total pressure, when pure carbon dioxide gas is used, or lower. When a carbon dioxide containing gas is used, the effective partial pressure of carbon dioxide depends upon the concentration of carbon dioxide in the gas. The effective partial pressure of carbon dioxide is preferably at least about one atmosphere at the bottom of the retort when flood leaching with downwardly flowing leaching agent is used, although it can be lower at higher elevations within the retort where hydrostatic pressure can be lower.

Enriched solution 36 containing magnesium values is withdrawn from the bottom of the retort 40 through the drift 51. At least a portion of the enriched solution can be withdrawn through a pipe 45 that passes through the bulkhead 49 and terminates in a sump 42. The enriched solution contains dissolved magnesium bicarbonate, dissolved carbon dioxide, and minor amounts of dissolved impurities. When the enriched solution is withdrawn, it is at the pressure prevailing at the bottom of the retort and contains dissolved carbon dioxide at a sufficient partial pressure to maintain the dissolved magnesium bicarbonate in solution.

The pressure of enriched solution withdrawn from a fragmented mass is lowered to about ambient pressure or lower for precipitating magnesium values. Dissolved carbon dioxide comes out of solution as carbon dioxide gas. As carbon dioxide comes out of solution, the solubility of the magnesium bicarbonate decreases; and hydrated magnesium carbonate precipitates from solution. The carbon dioxide can be recovered and reused for precarbonating or leaching.

Because carbon dioxide readily comes out of aqueous solution when the pressure is lowered or the temperature is raised, it is referred to herein as a "purgeable acid-forming gas", indicating that the carbon dioxide can be purged from the enriched solution for precipitation of magnesium values. Sulfur dioxide is also a purgeable acid-forming gas. When carbon dioxide and sulfur dioxide are combined in the proper proportions, recovery of magnesium values is improved.

The precipitation of magnesium carbonate can be accomplished in a variety of ways. For example, enriched solution can be introduced to a settling pond or tank where carbon dioxide passes into the atmosphere and magnesium carbonate precipitates. Techniques for precipitating magnesium carbonate from aqueous solutions of carbon dioxide and magnesium bicarbonate are described in the above mentioned Bureau of Mines Technical Paper 684.

RETORTING PHASE

(a) Retorting Operations

Although the process disclosed herein for leaching magnesium values from combusted oil shale is discussed in relation to in situ retorting of oil shale, the process can be practiced with combusted oil shale from above ground methods of retorting. Many of these methods for retorting oil shale are described in *Synthetic Fuels Data Handbook,* compiled by Dr. Thomas A. Hendrickson, and published by Cameron Engineers, Inc., Denver, Colorado. For example, other processes for retorting oil shale include these known as the TOSCO, Paraho Direct, Paraho Indirect, N-T-U, Union Oil and Bureau of Mines, Rock Springs, processes.

The TOSCO retorting process is described on pages 75 and 76 of the *Synthetic Fuels Data Handbook* and the United States Patents mentioned therein, including United States Pat. No. 3,025,223. Generally speaking, this process involves preheating minus ½ inch oil shale to about 500° F. in a fluidized bed. Pyrolysis is completed in a rotating drum heated by ceramic balls which are separately heated in a ball-heating furnace. Retorted oil shale can be combusted in a fluidized bed for reheating the ceramic balls.

The Paraho process is described at pages 62, 63, 84 and 85 of the *Synthetic Fuels Data Handbook* and the United States patents referred to therein. The Paraho process employs a vertical kiln through which ground oil shale moves downwardly as gas moves upwardly. Combustion air can be admitted into the bed of oil shale particles for direct heating of oil shale by combustion within the bed. This process is referred to as Paraho Direct. The kiln can also be arranged so that recycled gas can be heated externally, then injected into the bed of oil shale for indirect heating of the oil shale. Such a process is referred to as Paraho Indirect. Retorted Oil shale from the Paraho indirect process can be combusted to provide the heat for indirect heating of the oil shale.

The Union Oil process resembles the Paraho Direct process except the oil shale moves upwardly through retort vessel. A "rock pump" forces the oil shale particles into the bottom of the bed and particles of combusted oil shale overflow at the top.

The N-T-U process is a batch process as described at page 59 of the *Synthetic Fuels Data Handbook* and the United States patents referred therein. In the N-T-U process, a retort is filled with a batch of oil shale particles and ignited at the top. Combustion is supported by air injection and a combustion zone is passed downwardly through the stationary bed of shale. Recycled gas from the bottom of the retort is mixed with the combustion gas to modulate temperatures and provide some of the fuel requirement.

The Bureau of Mines, Rock Springs process is described in the *Synthetic Fuels Data Handbook* and also in Paper No. SPE-6067 prepared for the 51st Annual Technical Conference and Exhibition of the Society of Petroleum Engineers of AIME, held in New Orleans, October 3-6, 1976, by R. L. Wise, et al. Such a process is also described in U.S. Pat. No. 3,346,044, among others. Generally speaking, this process involves fracturing of an underground oil shale formation with the fractures propped open with sand. Injection and production wells are drilled into the formation. A combustion zone is moved from an injection well towards one or more production wells for retorting oil shale in the fractured formation.

The above ground processes are generally characterized by small particle size and short times at elevated temperature as compared with in situ retorting processes. Mineral changes and leaching rates can therefore differ. A detailed description of an in situ retorting process follows.

Referring again to FIG. 1, an in situ oil shale retort 10 is in the form of a cavity 12 formed in a subterranean formation 14 containing oil shale. The cavity contains a fragmented permeable mass 16 of formation particles containing oil shale. The cavity 12 can be created simultaneously with fragmentation of the mass of formation particles by blasting by any of a variety of techniques. A desirable technique involves excavating or mining a void within the boundaries of an in situ oil shale retort site to be formed in the subterranean formation and explosively expanding remaining oil shale in the formation toward such a void. In situ oil shale retorts formed in accordance with the disclosures of U.S. Pat. Nos. 3,661,423; 4,043,595; 4,043,596; 4,043,597; and 4,043,598, incorporated herein by this reference, are suitable for recovery of shale oil and magnesium values in accordance with this invention.

A conduit 17 communicates with the top of the fragmented mass of formation particles, or a plurality of conduits 17 can be used. During the retorting operation of the retort 10, a combustion zone is established in the retort by ignition of carbonaceous material in oil shale in the fragmented mass. The combustion zone is advanced through the fragmented mass by introducing an oxygen containing retort inlet mixture into the in situ oil shale retort through the conduit 17 as a combustion zone feed. Oxygen introduced to the retort in the retort inlet mixture oxidizes carbonaceous material in the oil shale to produce combustion gas.

Combustion gas produced in the combustion zone and any unreacted portion of the combustion zone feed pass through the fragmented mass of particles on the advancing side of the combustion zone to establish a retorting zone on the advancing side of the combustion zone. Kerogen in the oil shale is retorted in the retorting zone to produce liquid products including shale oil, and gaseous products including combustible gaseous products.

There is an access tunnel adit, drift 20 or the like in communication with the bottom of the retort. The drift contains a sump 22 in which liquid products 23, including shale oil and water, are collected to be withdrawn. A network of perforated pipes 21 is provided at the base of the fragmented mass for withdrawal of off gas. An off gas 24 containing gaseous products, combustion gas, carbon dioxide from carbonate decomposition, and any gaseous unreacted portion of the combustion zone feed, is also withdrawn through the perforated pipe means 21 through a bulkhead or sealing means 29 in the drift 20.

After the combustion zone has been advanced through the fragmented mass, some of the particles in the mass can be at an elevated temperature which can be in excess of 500° C. The oil shale in the retort gradually cools toward ambient temperature when retorting and combustion are complete. Before introduction of aqueous leaching agent, particles in the mass are cooled to temperatures at which liquid aqueous leaching agent will remain liquid at the leaching pressures employed. In an embodiment of this invention, the cooling gas is a carbon dioxide containing gas. Such carbon dioxide combines preferentially with calcium in the fragmented mass and reduces consumption of carbon dioxide in the leaching phase.

(b) Temperature effects

The maximum temperature of oil shale particles is controlled during combustion in a range of temperature sufficient for converting magnesium values in the oil shale to a form that is more leachable with an aqueous solution of carbon dioxide and below a temperature at which leachable magnesium values are converted to a less leachable mineral form. In above ground retorting where the time at elevated temperatures is relatively short it is preferred that the maximum temperature be in the range of about 600° to 900° C. Preferably the maximum temperature is less than about 730° C. for improved leaching. In situ retorting involves appreciably longer times at elevated temperature and lower maximum temperatures are desirable to minimize formation of silicate minerals of low solubility in the solutions described herein. The maximum temperature can be controlled by monitoring the temperature of the combustion zone, and regulating the composition of the combustion zone feed for controlling the combustion zone temperature. The concentration of oxygen, the concentration of diluent such as steam or recycled off gas, the concentration of added fuel, if any, and the flow rate of the combustion zone feed can all be varied for controlling the maximum temperature in the combustion zone.

Leaching of magnesium values can be enhanced by controlling conditions during retorting and combustion for converting oil shale to an aqueous liquid permeable mineral form that retains its permeability during leaching, for example, by controlling the maximum temperature in the combustion zone in the range of from about 600° to 800° C., more preferably from about 600° to 730° C. for above ground retorting and lower temperatures for in situ retorting. When the maximum temperature in the combustion zone is controlled within the range of about 600° to 730° C., a substantially higher recovery of magnesium values is obtained before the rate of leaching declines than is the case when maximum temperatures much above 730° C. are used.

Maximum temperatures below about 730° C., can provide preferential decomposition of carbonate of magnesium in oil shale with respect to carbonate of calcium because at such temperatures carbonate of magnesium in oil shale decomposes faster than carbonate of calcium.

LABORATORY RESULTS

Laboratory tests have been made to show the effect of sulfur dioxide in a leaching process for extracting magnesium values from combusted oil shale. In the laboratory tests a crushed and screened sample of combusted oil shale was placed in a 500 milliliter leach column. Fluid connections were made to the column so that a leach solution could be circulated through the mass of fragmented combusted shale in the column. In each of the tests, the liquid to solid ratio was maintained at 2:1. Three hundred milliliters of deionized water was circulated from the bottom of the column to the top of the column at a rate of 5 milliliters per minute and permitted to flow downwardly through the column. The column was sparged from the bottom with either carbon dioxide gas or a gas containing 98.8% carbon dioxide and 1.2% by volume sulfur dioxide. Ten milliliter aliquot samples were removed for analysis and replaced in the leachant by an equivalent quantity of deionized water.

Figure 2:
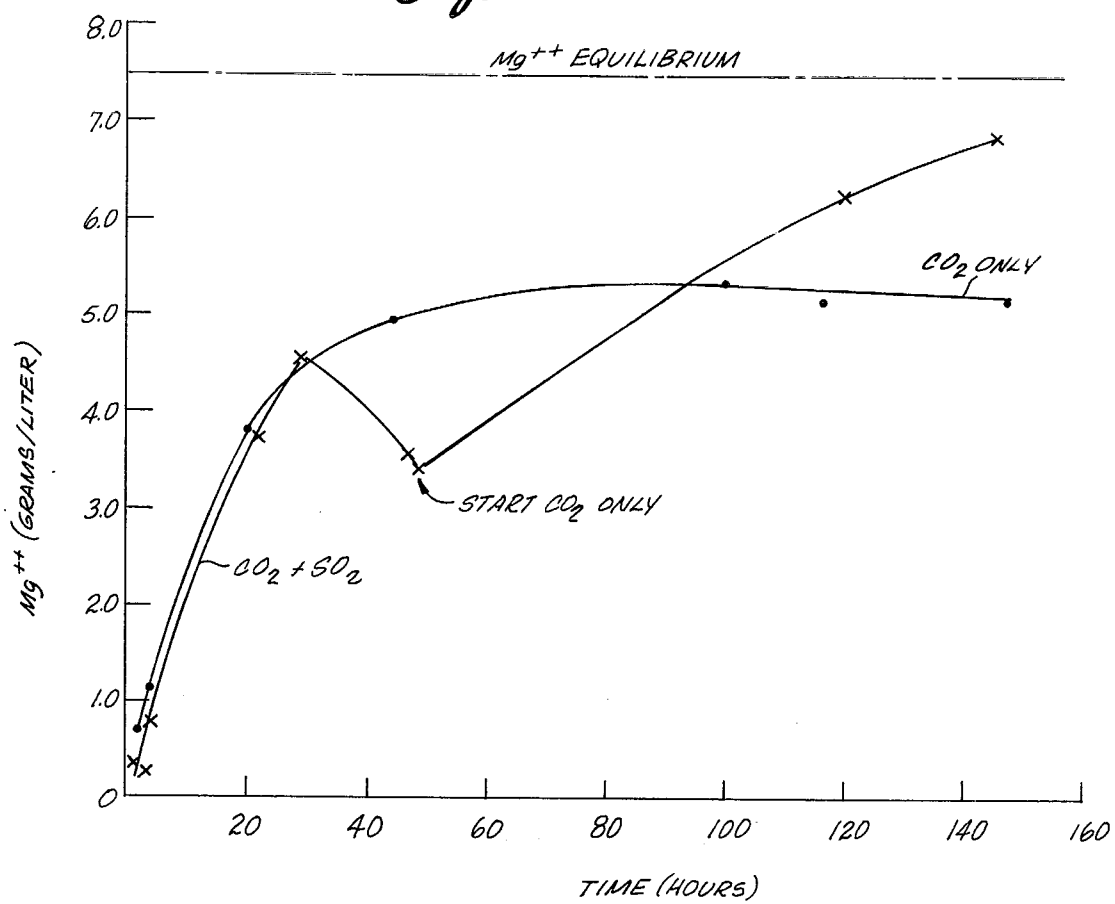
FIG. 2 is a graph showing the recovery of magnesium values when a minor proportion of sulfur dioxide is dissolved in the aqueous leaching agent followed by discontinuance of the sulfur dioxide proportion.

FIG. 2 is a graph illustrating the results of one pair of laboratory leaching tests in such a column. In FIG. 2 the magnesium ion concentration in grams per liter in the leach solution is plotted as a function of time of circulation of the leachant. In one test a column was prepared containing combusted oil shale having a maximum particle size of ¼ inch and a minimum particle size of 6 mesh. Carbon dioxide was sparged in the leachant at a rate of 500 milliliters per minute during the leaching test. The concentration of magnesium ion in the solution increased for a period of about two days and thereafter showed essentially no further increase. The concentration of magnesium ion is illustrated in FIG. 2 by the curve labelled "$CO_2$ only".

The maximum magnesium ion concentration in such a solution was determined at the end of this part of the test. Three hundred milliliters of the final solution were carbonated at a flow rate of 500 milliliters of carbon dioxide per minute while in contact with an excess of magnesium hydroxide. At equilibrium the magnesium concentration was 7.42 grams of magnesium ion per liter, as indicated by the phantom line in FIG. 2.

In another test on a similar sample of combusted oil shale, the column was loaded with a fragmented mass of combusted oil shale having a maximum particle size of ¼ inch and a minimum particle size of 6 mesh. Three hundred milliliters of deionized water were employed as the leachant and gas containing 1.2% by volume sulfur dioxide and a balance of carbon dioxide was sparged at a flow rate of 100 milliliters per minute. The magnesium ion concentration in the leach solution increased gradually for about one day and then decreased. As the concentration of magnesium ion increased it was roughly the same as the concentration of magnesium ion in the solution containing carbon dioxide only.

After 48.5 hours of contact with leachant containing carbon dioxide and sulfur dioxide a substantial decrease in magnesium ion concentration in the leach solution had occurred and addition of sulfur dioxide was discontinued. Thereafter, carbon dioxide only was sparged at a rate of 500 milliliters per minute. The concentration of magnesium ion in the leach solution increased to a concentration substantially above the concentration of magnesium ion in the solution from the first test. The results of the test wherein during a first stage a solution containing a major proportion of carbon dioxide and a minor proportion of sulfur dioxide was used as a leachant and during a second stage a solution containing carbon dioxide in the substantial absence of sulfur dioxide was used as a leachant is illustrated in FIG. 2 by the curve labelled "$CO_2+SO_2$".

Figure 3:
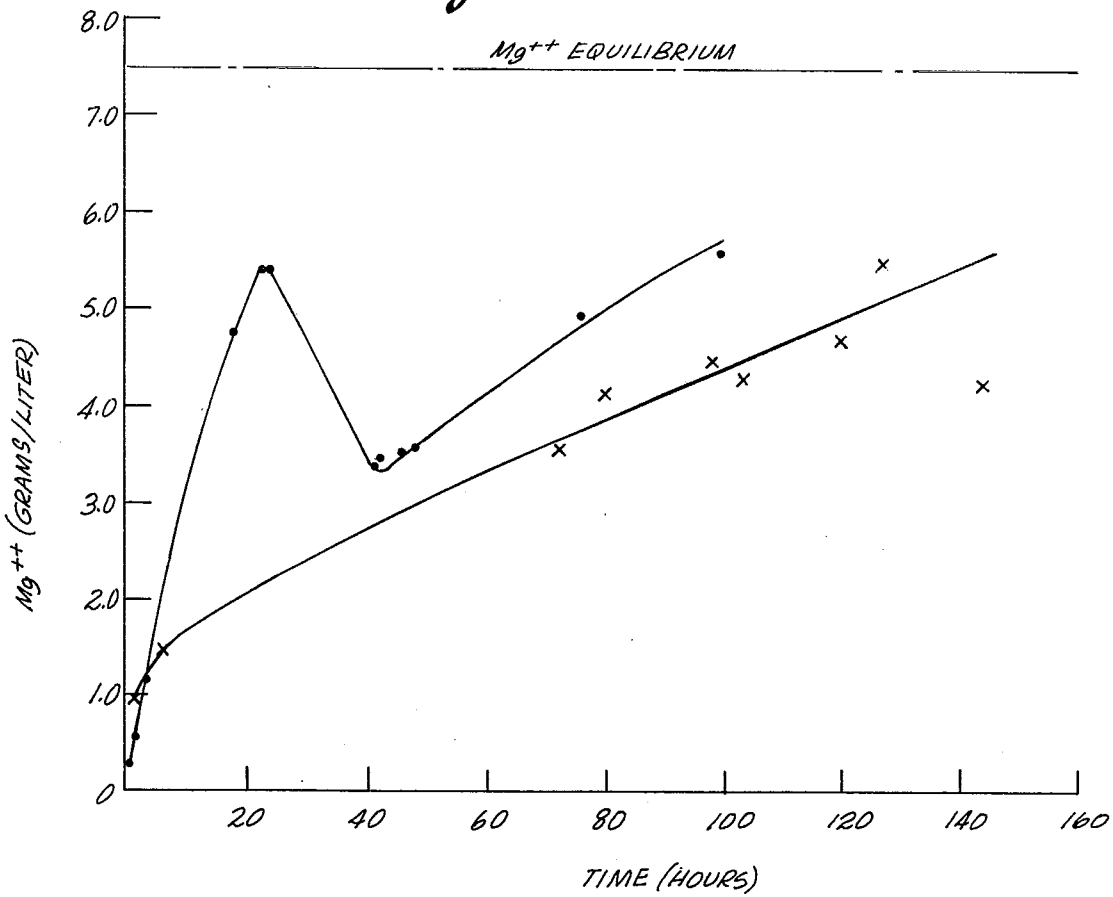
FIG. 3 is a graph similar to FIG. 2.

FIG. 3 illustrates the results of another pair of similar laboratory leaching tests in such a column. In one test a column was prepared containing combusted oil shale having a maximum particle size of ¼ inch and a minimum particle size of ⅛ inch. Carbon dioxide was sparged in the leachant at a rate of 500 milliliters per minute during the leaching test. The concentration of magnesium ion in the solution appeared to increase throughout the test period. The concentration is illustrated in FIG. 3 by the curve labelled "$CO_2$ only".

In the second test of this pair the column was loaded with a similar fragmented mass of combusted oil shale. Three hundred milliliters of deionized water were employed in the leachant and gas containing 1.2% by volume sulfur dioxide and a balance of carbon dioxide was sparged at a flow rate of 100 milliliters per minute. The magnesium ion concentration in the leach solution increased rapidly for about one day and then decreased.

After 46 hours of contact with leachant containing carbon dioxide and sulfur dioxide a substantial decrease in magnesium ion concentration in the leach solution had occurred and addition of sulfur dioxide was discontinued. Thereafter carbon dioxide only was sparged at a rate of 500 milliliters per minute. The concentration of magnesium ion in the leach solution increased to a concentration substantially above the concentration of magnesium ion in a solution from the first test of this pair. The results of the test wherein during a first stage a solution containing a major proportion of carbon dioxide and a minor proportion of sulfur dioxide was used as a leachant and during the second stage a solution containing carbon dioxide in the substantial absence of sulfur dioxide was used as a leachant is illustrated in FIG. 3 by the curve labelled "$CO_2+SO_2$".

What is claimed is:

1. In a method for recovering shale oil and leaching magnesium values from formation particles in an in situ oil shale retort in a subterranean formation containing oil shale and magnesium values which comprises: advancing a combustion zone through a fragmented permeable mass of formation particles containing oil shale and magnesium values in an in situ oil shale retort by introducing an oxygen containing gas to the fragmented mass on the trailing side of the combustion zone and withdrawing an off gas from the fragmented mass on the advancing side of the combustion zone, whereby gas flowing through the combustion zone transfers heat of combustion to a retorting zone in the fragmented mass on the advancing side of the combustion zone and wherein kerogen in oil shale in the retorting zone is decomposed to produce gaseous and liquid products including shale oil and carbonaceous residue, such carbonaceous residue supporting combustion in the combustion zone at sufficient temperatures for converting oil shale to a form from which magnesium values can be selectively leached, and selectively leaching magnesium values from at least a portion of the fragmented mass by contacting particles in the fragmented mass with an acidic aqueous leaching agent containing dissolved carbon dioxide for forming enriched solution containing dissolved carbon dioxide and magnesium values, withdrawing enriched solution containing magnesium values from the retort, and recovering magnesium values from such enriched solution; the improvement comprising:

a two phase leaching process comprising introducing during at least a first phase of the leaching process sufficient dissolved sulfur dioxide in the aqueous leaching agent for increasing, when combined with the second phase, the concentration of magnesium values leached into aqueous solution of carbon dioxide relative to the concentration of magnesium values leached into aqueous solution of carbon dioxide without introduction of sulfur dioxide; and thereafter, during a second phase of the leaching process, contacting at least a portion of the fragmented mass with an aqueous leaching agent containing carbon dioxide in the substantial absence of sulfur dioxide.

2. A method as recited in claim 1 in which sufficient sulfur dioxide is introduced into the aqueous leaching agent during the first phase for lowering the pH of the aqueous solution of carbon dioxide about one third to one unit of pH relative to the pH of the aqueous solution of carbon dioxide without introduction of sulfur dioxide.

3. A method as recited in claim 1 wherein the first phase comprises the step of contacting at least a portion of the fragmented mass with aqueous liquid and introducing gas containing carbon dioxide and sulfur dioxide to the portion of the fragmented mass in contact with the aqueous liquid.

4. A method as recited in claim 1 in which carbon dioxide is present in at least a portion of the fragmented mass at an effective partial pressure of at least about one atmosphere and sulfur dioxide is present in at least a portion of the fragmented mass at an effective partial pressure of at least about 1% of the partial pressure of the carbon dioxide.

5. A method as recited in claim 1 which comprises trickling leaching agent downwardly through the fragmented mass.

6. A method as recited in claim 5 which comprises flowing gas containing carbon dioxide and sulfur dioxide upwardly through the fragmented mass.

7. A method as recited in claim 1 which comprises substantially flooding at least a portion of the fragmented mass with leaching agent containing dissolved sulfur dioxide and carbon dioxide and flowing such leaching agents downwardly through the flooded portion of the fragmented mass.

8. A method as recited in claim 7 which comprises introducing gas containing carbon dioxide and sulfur dioxide upwardly into the flooded portion of the fragmented mass.

9. A method as recited in claim 1 wherein the first phase is ended and the second phase is started when the equilibrium concentration of magnesium values in the enriched solution reaches a maximum.

10. In a method for recovering shale oil and leaching magnesium values from formation particles in an in situ oil shale retort in a subterranean formation containing oil shale and magnesium values which comprises: advancing a combustion zone through a fragmented permeable mass of formation particles containing oil shale and magnesium values in an in situ oil shale retort by introducing an oxygen-containing gas to the fragmented mass on a trailing side of the combustion zone and withdrawing an off gas from the fragmented mass on an advancing side of the combustion zone, whereby gas flowing through the combustion zone transfers heat of combustion to a retorting zone in the fragmented mass on the advancing side of the combustion zone and wherein kerogen in oil shale in the retorting zone is decomposed to produce gaseous and liquid products including shale oil and carbonaceous residue, said carbonaceous residue supporting combustion in the combustion zone at sufficient temperatures for converting oil shale to a form from which magnesium values can be selectively leached, selectively leaching magnesium values from at least a portion of the fragmented mass with an aqueous leaching agent containing sufficient dissolved carbon dioxide for forming enriched solution containing magnesium values, withdrawing enriched solution containing magnesium values from the fragmented mass, and recovering magnesium values from such enriched solution; the improvement comprising:

introducing during at least a first interval sufficient dissolved sulfur dioxide in the aqueous leaching agent for lowering the pH of the aqueous solution of carbon dioxide about one third to one unit of pH relative to the pH of the aqueous solution of carbon dioxide without introduction of sulfur dioxide; and thereafter, during a second time interval, contacting at least a portion of the fragmented mass with an aqueous leaching agent containing carbon dioxide in the substantial absence of sulfur dioxide.

11. A method as recited in claim 10 in which gaseous carbon dioxide is present in at least a portion of the fragmented mass at an effective partial pressure of at least about one atmosphere and sulfur dioxide is present in at least a portion of the fragmented mass at an effective partial pressure of at least about 1% of the partial pressure of the carbon dioxide.

12. A method as recited in claim 11 which comprises substantially flooding at least a portion of the fragmented mass with leaching agent, flowing such leaching agents downwardly through the flooded portion, and introducing carbon dioxide and sulfur dioxide containing gas upwardly into the fragmented mass.

13. In a method for recovering shale oil and leaching magnesium values from formation particles in an in situ oil shale retort in a subterranean formation containing oil shale and magnesium values which comprises: advancing a combustion zone through a fragmented permeable mass of formation particles containing oil shale and magnesium values in an in situ oil shale retort by introducing an oxygen-containing gas into the fragmented mass on a trailing side of the combustion zone and withdrawing an off gas from the fragmented mass on an advancing side of the combustion zone, whereby gas flowing through the combustion zone transfers heat of combustion to a retorting zone in the fragmented mass on the advancing side of the combustion zone, and wherein kerogen in oil shale in the retorting zone is decomposed to produce gaseous and liquid products including shale oil and carbonaceous residue, said carbonaceous residue supporting combustion in the combustion zone at sufficient temperatures for converting at least a portion of the magnesium values in the fragmented mass to a form from which magnesium values can be selectively leached, contacting at least a portion of the cooled fragmented mass with an aqueous leaching agent containing sufficient dissolved carbon dioxide for forming enriched solution containing magnesium values, withdrawing enriched solution containing magnesium values from the fragmented mass; and recovering magnesium values from such enriched solution, the improvement comprising: including sulfur dioxide in the aqueous leaching agent in a minor amount relative to the amount of carbon dioxide.

14. A method as recited in claim 13 in which carbon dioxide is present in at least a portion of the fragmented mass at an effective partial pressure of at least about one atmosphere and sulfur dioxide is present in at least a portion of the fragmented mass at an effective partial pressure of at least about 1% of the partial pressure of the carbon dioxide.

15. A method for recovering shale oil and leaching magnesium values from particles containing oil shale and carbonate of magnesium which comprises:

retorting oil shale at a sufficient temperature that kerogen in oil shale is decomposed to produce gaseous and liquid products including shale oil, and carbonaceous residue;

burning such carbonaceous residue in a combustion zone at sufficient temperatures for converting at least a portion of the oil shale in the particles to combusted oil shale from which magnesium values can be leached;

contacting at least a portion of the particles of combusted oil shale with an aqueous leaching agent containing sufficient dissolved carbon dioxide and sulfur dioxide for forming an enriched solution containing dissolved magnesium bicarbonate, and insufficient sulfur dioxide for forming magnesium bisulfite or magnesium sulfite; and recovering basic magnesium values from such enriched solution.

16. A method for recovering shale oil and leaching magnesium values from particles containing oil shale and carbonate of magnesium which comprises:

retorting such particles for decomposing kerogen in oil shale to produce gaseous and liquid products including shale oil and heating retorted particles at a maximum temperature sufficient for converting oil shale to a form from which magnesium values can be leached;

contacting such retorted heated particles with an aqueous solution containing sufficient dissolved carbon dioxide for selectively leaching magnesium values from the particles and for forming an enriched solution containing such magnesium values, the aqueous solution also containing a minor amount of dissolved sulfur dioxide relative to the amount of carbon dioxide in the solution;

separating such enriched solution from the particles; and recovering magnesium values from such enriched solution.

17. A method as recited in claim 16 wherein the sulfur dioxide is present in the aqueous solution at an effective partial pressure of at least about 1% of the partial pressure of the carbon dioxide.

18. A method as recited in claim 16 further comprising the steps of:

extracting carbon dioxide and hydrogen sulfide from an off gas from oil shale retorting;

oxidizing such hydrogen sulfide to sulfur dioxide; and dissolving such carbon dioxide and sulfur dioxide for forming the aqueous solution.

19. A method as recited in claim 16 wherein the sulfur dioxide is present in the aqueous solution in an amount insufficient for forming magnesium bisulfite or magnesium sulfite.

20. A method as recited in claim 16 wherein the sulfur dioxide is present in the aqueous solution in an amount sufficient for lowering the pH of the aqueous solution about one third to one unit of pH relative to the pH of an aqueous solution of carbon dioxide without sulfur dioxide.

21. A method for leaching of magnesium values from combusted oil shale particles comprising the step of contacting combusted oil shale particles with an aqueous leaching agent comprising dissolved carbon dioxide and dissolved sulfur dioxide, the dissolved sulfur dioxide present in a minor amount relative to a major amount of carbon dioxide.

22. A method as recited in claim 21 performed for a first time interval; thereafter, for a second time interval, leaching with an aqueous leaching agent containing carbon dioxide in the substantial absence of sulfur dioxide.

23. A method as recited in claim 21 wherein the sulfur dioxide is present in the aqueous solution at an effective partial pressure of at least about 1% of the partial pressure of the carbon dioxide.

24. A method as recited in claim 21 wherein the sulfur dioxide is present in the aqueous solution in an amount insufficient for forming magnesium bisulfite or magnesium sulfite.

25. A method as recited in claim 21 wherein the sulfur dioxide is present in the aqueous solution in an amount sufficient for lowering the pH of the aqueous solution about one third to one unit of pH relative to the pH of an aqueous solution of carbon dioxide without sulfur dioxide.

26. A method for recovering shale oil and leaching magnesium values from formation particles in an in situ oil shale retort in an subterranean formation containing oil shale and magnesium values which comprises the steps of:

advancing a combustion zone through a fragmented permeable mass of formation particles containing oil shale and magnesium values in an in situ oil shale retort by introducing an oxygen containing gas to the fragmented mass on the trailing side of the combustion zone and withdrawing an off gas from the fragmented mass on the advancing side of the combustion zone, whereby gas flowing through the combustion zone transfers heat of combustion to a retorting zone in the fragmented mass on the advancing side of the combustion zone and wherein kerogen in oil shale in the retorting zone is decomposed to produce gaseous and liquid products including shale oil and carbonaceous residue, such carbonaceous residue supporting combustion in the combustion zone at sufficient temperatures for converting oil shale to a form from which magnesium values can be selectively leached;

selectively leaching magnesium values from at least a portion of the fragmented mass by the steps of:

contacting particles in the fragmented mass with an acidic aqueous leaching agent containing dissolved carbon dioxide and dissolved sulfur dioxide in a minor amount relative to the dissolved carbon dioxide for forming enriched solution containing dissolved magnesium values;

withdrawing enriched solution containing magnesium values from the retort; and recovering magnesium values from such enriched solution.

27. A method as recited in claim 26 wherein a second phase of the leaching process comprises contacting at least a portion of the fragmented mass with an aqueous leaching agent containing carbon dioxide in the substantial absence of sulfur dioxide for forming an enriched solution containing dissolved magnesium values;

withdrawing enriched solution containing magnesium values from the retort; and recovering magnesium values from such enriched solution.

28. A method as recited in claim 27 in which sufficient sulfur dioxide is introduced into the aqueous leaching agent during the first mentioned phase of the leaching process for lowering the pH of the aqueous solution of carbon dioxide about one third to one unit of pH relative to the pH of an aqueous solution of carbon dioxide without introduction of sulfur dioxide.

29. A method as recited in claim 27 wherein the first mentioned phase is ended and the second phase is started when the equilibrium concentration of magnesium values in the enriched solution reaches a maximum.

30. A method as recited in claim 26 in which sufficient sulfur dioxide is introduced into the aqueous leaching agent for lowering the pH of the aqueous solution of carbon dioxide about one third to one unit of pH relative to the pH of an aqueous solution of carbon dioxide without introduction of sulfur dioxide.

31. A method as recited in claim 26 in which carbon dioxide is present in at least a portion of the fragmented mass at an effective partial pressure of at least about one atmosphere and sulfur dioxide in at least a portion of the fragmented mass is present at an effective partial pressure of at least about 1% of the partial pressure of the carbon dioxide.

32. A method as recited in claim 26 which comprises substantially flooding at least a portion of the fragmented mass with leaching agent containing dissolved sulfur dioxide and carbon dioxide and flowing such leaching agents downwardly through the flooded portion of the fragmented mass.

33. A method as recited in claim 32 which comprises introducing gas containing carbon dioxide and sulfur dioxide upwardly into the flooded portion of the fragmented mass.

34. A method as recited in claim 26 further comprising the steps of:

extracting carbon dioxide and hydrogen sulfide from off gas from in situ oil shale retorting;

oxidizing such hydrogen sulfide to sulfur dioxide; and dissolving such carbon dioxide and sulfur dioxide for forming the aqueous leaching agent.

35. A method for recovering shale oil and leaching magnesium values from formation particles in an in situ oil shale retort in a subterranean formation containing oil shale and magnesium values which comprises the steps of:

advancing a combustion zone through a fragmented permeable mass of formation particles containing oil shale and magnesium values in an in situ oil shale retort by introducing an oxygen containing gas to the fragmented mass on the trailing side of the combustion zone and withdrawing an off gas from the fragmented mass on the advancing side of the combustion zone, whereby gas flowing through the combustion zone transfers heat of combustion to a retorting zone in the fragmented mass on the advancing side of the combustion zone and wherein kerogen in oil shale in the retorting zone is decomposed to produce gaseous and liquid products including shale oil and carbonaceous residue, such carbonaceous residue supporting combustion in the combustion zone at sufficient temperatures for converting oil shale to a form from which magnesium values can be selectively leached;

selectively leaching magnesium values from at least a portion of the fragmented mass by the steps of:

during a first phase of the leaching process contacting particles in the fragmented mass with an acidic aqueous leaching agent containing dissolved carbon dioxide and sufficient dissolved sulfur dioxide for increasing the concentration of magnesium values leached into aqueous solution of carbon dioxide relative to the concentration of magnesium values leached into aqueous solution of carbon dioxide without introduction of sulfur dioxide for forming enriched solution containing dissolved carbon dioxide and magnesium values; and thereafter, during a second phase of the leaching process, contacting particles in the fragmented mass with an acidic aqueous leaching agent containing dissolved carbon dioxide in the substantial absence of sulfur dioxide for forming enriched solution containing dissolved carbon dioxide and magnesium values; withdrawing enriched solution containing magnesium values from the retort; and recovering magnesium values from at least a portion of such enriched solution.

36. A method as recited in claim 35 in which gaseous carbon dioxide is present in at least a portion of the fragmented mass at an effective partial pressure of at least about one atmosphere and sulfur dioxide is present in at least a portion of the fragmented mass at an effective partial pressure of at least about 1% of the partial pressure of the carbon dioxide.

37. A method as recited in claim 36 which comprises substantially flooding at least a portion of the fragmented mass with leaching agent, flowing such leaching agents downwardly through the flooded portion, and introducing carbon dioxide and sulfur dioxide containing gas upwardly into the fragmented mass.

38. A method as recited in claim 35 in which sufficient sulfur dioxide is introduced into the aqueous leaching agent during the first phase for lowering the pH of the aqueous solution of carbon dioxide about one third to one unit of pH relative to the pH of the aqueous solution of carbon dioxide without introduction of sulfur dioxide.

39. A method as recited in claim 35 wherein the sulfur dioxide is present in the aqueous solution in a minor amount relative to a major amount of carbon dioxide.

40. A method as recited in claim 35 further comprising the steps of:

extracting carbon dioxide and hydrogen sulfide from off gas from in situ oil shale retorting;

oxidizing such hydrogen sulfide to sulfur dioxide; and dissolving such carbon dioxide and sulfur dioxide for forming the aqueous leaching agent for the first phase of the leaching process.

41. A method for recovering shale oil and leaching magnesium values from particles containing oil shale and magnesium values which comprises the steps of:

retorting oil shale at a sufficient temperature that kerogen in oil shale in the particles is decomposed to produce gaseous and liquid products including shale oil and carbonaceous residue;

burning such carbonaeous residue in a combustion zone at sufficient temperatures for converting at least a portion of the particles to a form from which magnesium values can be selectively leached;

selectively leaching magnesium values from at least a portion of the particles by the steps of:

during a first phase of the leaching process contacting particles with an acidic aqueous leaching agent containing dissolved carbon dioxide and sufficient dissolved sulfur dioxide for increasing the concentration of magnesium values leached into aqueous solution of carbon dioxide relative to the concentration of magnesium values leached into aqueous solution of carbon dioxide without introduction of sulfur dioxide for forming enriched solution containing dissolved carbon dioxide and magnesium values and thereafter, during a second phase of the leaching process, contacting particles in the fragmented mass with an acidic aqueous leaching agent containing dissolved carbon dioxide in the substantial absence of sulfur dioxide for forming enriched solution containing dissolved carbon dioxide and magnesium values; and recovering magnesium values from at least a portion of such enriched solution.

42. A method as recited in claim 41 in which gaseous carbon dioxide is present in at least a portion of the fragmented mass at an effective partial pressure of at least about one atmosphere and sulfur dioxide is present in at least a portion of the fragmented mass at an effective partial pressure of at least about 1% of the partial pressure of the carbon dioxide.

43. A method as recited in claim 41 in which sufficient sulfur dioxide is introduced into the aqueous leaching agent during the first phase for lowering the pH of the aqueous solution of carbon dioxide about one third to one unit of pH relative to the pH of the aqueous solution of carbon dioxide without introduction of sulfur dioxide.

44. A method as recited in claim 41 wherein the sulfur dioxide is present in the aqueous solution in a minor amount relative to a major amount of carbon dioxide.

45. A method as recited in claim 41 wherein the sulfur dioxide is present in the aqueous solution in an amount insufficient for forming magnesium bisulfite or magnesium sulfite.

* * * * *

UNITED STATES PATENT AND TRADEMARK OFFICE

CERTIFICATE OF CORRECTION

PATENT NO. : 4,260,192

DATED : April 7, 1981

INVENTOR(S) : John L. Shafer

It is certified that error appears in the above—identified patent and that said Letters Patent is hereby corrected as shown below:

Column 2, line 60, "130°F." should be -- 1300°F. --.
Column 4, line 6, "magnesium contained therein values" should be -- magnesium values contained therein --.
Column 10, line 8, "particulates" should be -- particles --.
Column 10, line 62, "in" should be -- is --.
Column 16, line 41, "these" should be -- those --.
Column 24, line 41, "an" should be -- a --.

Signed and Sealed this

*Twenty-eighth* Day of *July 1981*

[SEAL]

*Attest:*

GERALD J. MOSSINGHOFF

*Attesting Officer*

*Commissioner of Patents and Trademarks*